US009194103B2

(12) United States Patent
McGee

(10) Patent No.: US 9,194,103 B2
(45) Date of Patent: Nov. 24, 2015

(54) TRACTOR MOUNTED EXCAVATION IMPLEMENT

(71) Applicant: Bruce Wade McGee, Meridian, MS (US)

(72) Inventor: Bruce Wade McGee, Meridian, MS (US)

(73) Assignee: Bruce Wade McGee, Meridian, MS (US)

( * ) Notice: Subject to any disclaimer, the term of this patent is extended or adjusted under 35 U.S.C. 154(b) by 138 days.

(21) Appl. No.: 13/986,534

(22) Filed: May 14, 2013

(65) Prior Publication Data

US 2014/0059898 A1 Mar. 6, 2014

Related U.S. Application Data

(60) Provisional application No. 61/688,412, filed on May 14, 2012.

(51) Int. Cl.
*E02F 5/08* (2006.01)
*E02F 9/20* (2006.01)

(52) U.S. Cl.
CPC .. *E02F 5/08* (2013.01); *E02F 9/202* (2013.01)

(58) Field of Classification Search
CPC ..... E02F 5/08; E02F 9/202
USPC ..... 172/537, 539, 540, 554; 37/91, 94, 347, 37/357, 378; 404/121, 122, 123, 124, 128, 404/132
See application file for complete search history.

(56) References Cited

U.S. PATENT DOCUMENTS

| | | | | | |
|---|---|---|---|---|---|
| 895,230 | A | * | 8/1908 | Beier | 172/554 |
| 1,246,524 | A | * | 11/1917 | Bager | 37/94 |
| 2,131,324 | A | * | 9/1938 | Hull | 172/554 |
| 2,403,367 | A | * | 7/1946 | Howard | 37/94 |
| 2,513,165 | A | * | 6/1950 | Gilreath | 172/545 |
| 2,537,802 | A | * | 1/1951 | Thomas | 172/548 |
| 2,984,024 | A | * | 5/1961 | Prenner et al. | 37/94 |
| 3,207,234 | A | * | 9/1965 | Stewart | 172/519 |
| 3,516,182 | A | * | 6/1970 | Wykert | 37/97 |
| 3,683,522 | A | | 8/1972 | Rousseau et al. | |
| 3,957,122 | A | * | 5/1976 | van der Lely | 172/60 |
| 4,282,662 | A | * | 8/1981 | Zucco | 37/94 |
| 4,324,056 | A | | 4/1982 | Sommerfeld | |
| 5,027,534 | A | | 7/1991 | Sackett | |
| 5,101,583 | A | * | 4/1992 | Scordilis | 37/91 |
| 5,203,100 | A | | 4/1993 | Snyder et al. | |
| 5,237,761 | A | | 8/1993 | Nadeau et al. | |
| 5,245,769 | A | * | 9/1993 | Wammock | 37/357 |
| 5,511,326 | A | | 4/1996 | Liebrecht, Jr. | |

(Continued)

*Primary Examiner* — Jamie L McGowan

(57) ABSTRACT

A tractor-mounted three-point-hitch implement, powered by the tractor power-take-off, with a rotational excavating apparatus for the excavation of linear depressions, including foundation footings, ditches and trenches. The rotational excavating apparatus for footings or trenches, having flat horizontal base and straight vertical sides, is cylindrical, drum-shaped, and made in sections, to allow for changes in width of depression. It is surfaced with claws and it rotates opposite the direction of the implement's movement, placing excavated spoils on the banks. The drum-shaped rotational excavating apparatus is removable for installing different sizes and shapes of rotational excavating apparatuses. A rotational excavating apparatus of spherical shape is used to form circular or rounded-U-shaped ditches, and one of prolate ellipsoid shape is used to form parabolic or rounded-V-shaped ditches that are shallow and easily mowed. The depth of cut is adjustable by the hydraulic lift on the tractor.

9 Claims, 3 Drawing Sheets

(56) References Cited

U.S. PATENT DOCUMENTS

| | | | | |
|---|---|---|---|---|
| 5,875,573 | A | 3/1999 | Hayden | |
| 6,260,293 | B1 * | 7/2001 | Monroe | 37/248 |
| 6,381,879 | B1 | 5/2002 | Bollich | |
| 6,560,905 | B2 * | 5/2003 | Monroe | 37/248 |
| 6,708,777 | B1 * | 3/2004 | Holmes | 172/684.5 |
| 6,860,043 | B1 * | 3/2005 | Heise et al. | 37/352 |
| 7,478,684 | B2 * | 1/2009 | Ward | 172/537 |
| 8,714,278 | B2 * | 5/2014 | Wright | 172/519 |
| 2005/0115119 | A1 * | 6/2005 | Coffey | 37/142.5 |

* cited by examiner

TRACTOR MOUNTED EXCAVATION IMPLEMENT

BACKGROUND

Discussion of Prior Art

The proposed embodiment herein relates generally to ditchers, trenchers, tractor implements, excavators, and earth moving machines used in the construction or agricultural fields.

Concrete filled footings, typically dug around the perimeter of a building for structural support have, in the past, been hand dug by shovels and picks. Today, footings are typically dug with backhoes and shaped with shovels to get exact grade. These back-saving machines are, however, awkward and bulky, with slow, erratic movements.

Trenchers with chain cutters are used for digging deep, narrow trenches for the laying of pipe and cable. U.S. Pat. No. 5,245,769 reveals a trencher readily attached to a conventional tractor. These machines, if made wider and simpler, could be used for excavating footings. The drawbacks are the long heavy booms with chain cutters, extra hydraulics, and maintenance.

Ditchers have been known in the maintenance of roads. U.S. Pat. Nos. 3,683,522; 4,324,056; 5,027,534; 5,203,100; 5,237,761; 5,875,573; and 6,381,879 all reveal tractor mounted ditchers. U.S. Pat. Nos. 2,953,863; 4,503,630; 4,939,854; and 4,958,457 all reveal walk-behind ditchers. None are made specifically for excavating rectangular footings with straight, vertical sides.

U.S. Pat. Nos. 4,768,297 and 7,637,038 B2 reveal mechanisms for making trenches in soil. These complex systems are not needed in the proposed embodiment.

BRIEF SUMMARY OF THE INVENTION

An innovative solution to these problems is to provide an implement specifically designed for excavating footings, ditches or trenches. This tractor-mounted implement consists of a frame attached with a three-point-hitch, supporting a rotational excavating apparatus, surfaced with claws, and powered by the tractor's power-take-off. This machine has no chain cutters, no added hydraulics, and no costly maintenance. A power diversion system deters power from the tractor's power-take-off to the drive mechanisms and ultimately to the rotational excavating apparatus. The sheer weight of the implement helps to maintain the depth provided the tractor operates in a creeper gear and does not encounter rocks or stumps. The rear portion of the frame is constructed to rake excavated spoils from the banks. A small guide disk helps the operator to direct the implement.

Another feature of the proposed implement is interchangeable rotational excavating apparatuses, easily removed to install varied apparatuses for excavating different sizes and shapes of linear depressions. These can be used in the construction/landscape fields, for tasks such as forming foundation footings, shallow ditches, round ditches and narrow trenches.

DESCRIPTION OF THE EMBODIMENT

Figure 1:
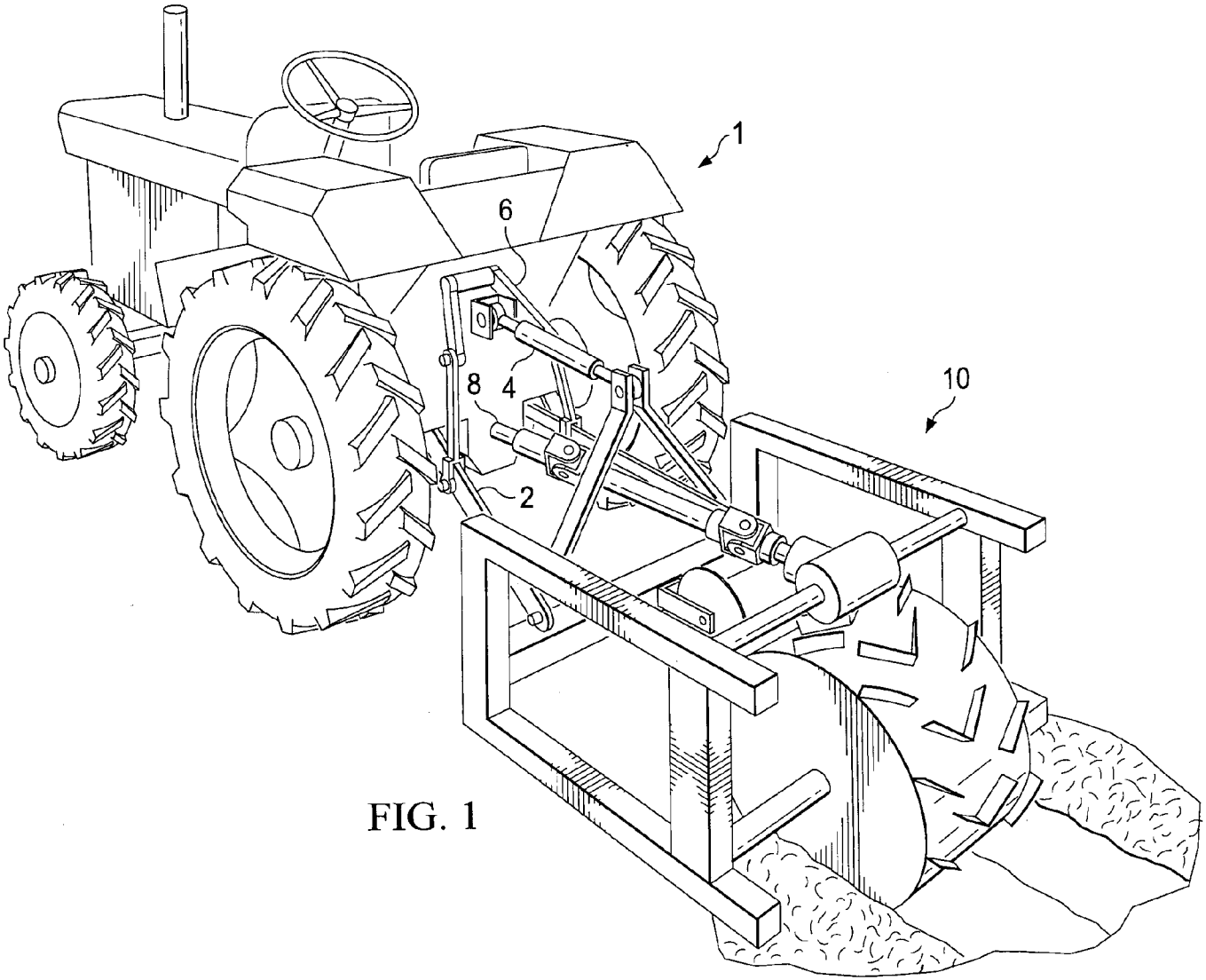
FIG. 1 is a perspective view of the proposed embodiment of implement showing how it is used in an operational configuration mounted to a conventional tractor.

FIG. 1 of drawings illustrates the proposed embodiment in operational configuration at a construction site. As seen, the tractor, indicated by numeral 1, includes a three-point hitch of common standard size consisting of lower lift arms spaced apart, indicated by numeral 2, and also a top link above, indicated by numeral 4, with a turn buckle to adjust position of implement. Tractor 1 also includes a hydraulic lift, indicated by numeral 6, and a power-take-off, indicated by numeral 8, commonly found on present-day tractors. The tractor 1 best operates in a creeper gear and has approximately 25 horse power, or more, depending on the size of the implement. The proposed embodiment, indicated by numeral 10, excavates a linear depression as it advances, pulled along the ground behind tractor 1. The implement 10 is heavily constructed yet compact for maneuvering around set batter boards and stakes.

Figure 2:
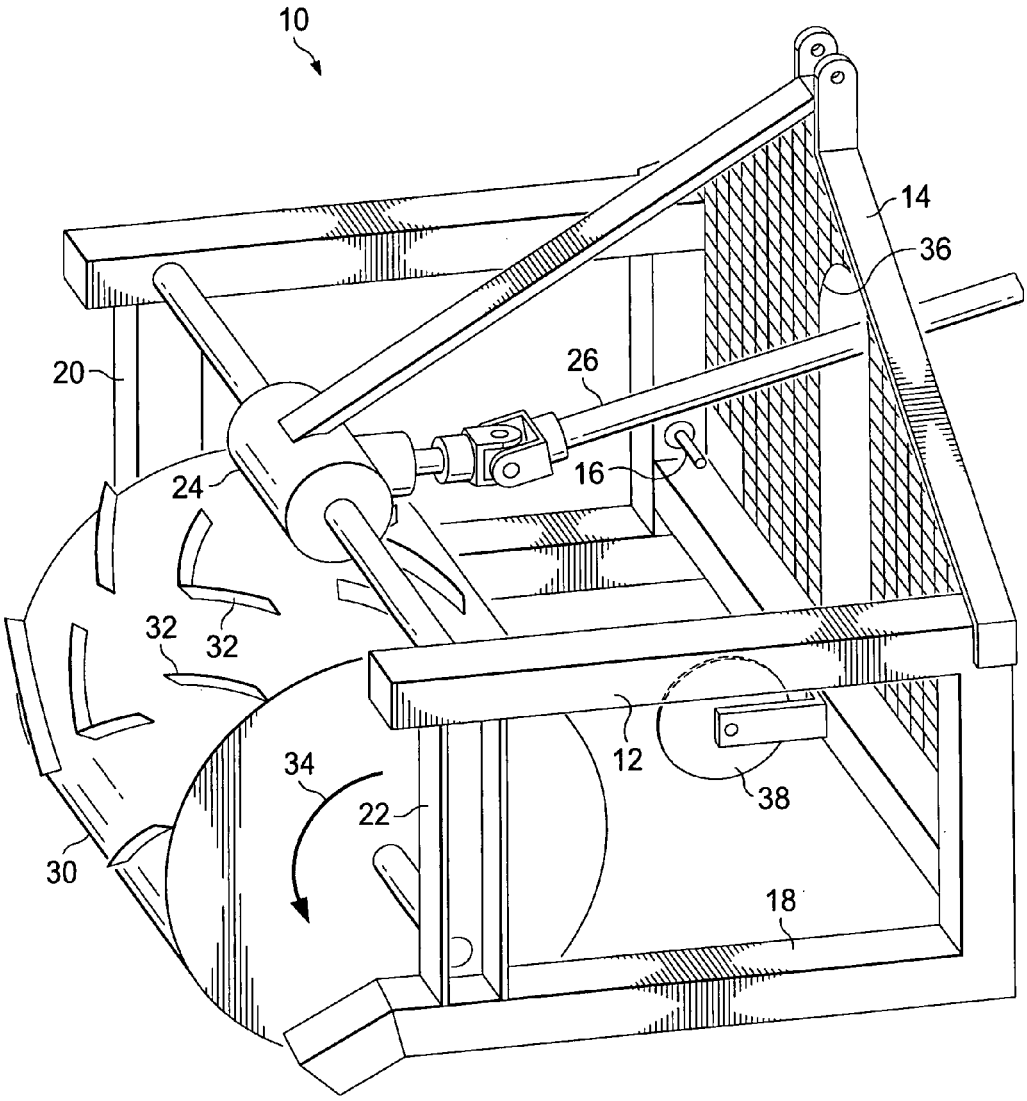
FIG. 2 shows a more detailed view of the implement with a rotational excavating apparatus of cylindrical or drum shape attached for forming foundation footings or trenches, showing how it is built, and how it works.

FIG. 2 shows a more detailed view of the proposed embodiment, how it is constructed, and how it works. Within the implement 10 is a frame indicated by numeral 12. The frame 12, constructed of heavy boxed iron, is substantially a rectangular, box-shaped perimetrical frame. It has two L-shaped sides connected by a horizontal member in front. Connected to the frame 12 are upper hitch supports indicated by numeral 14 and lower hitch pins indicated by numeral 16. Connected beneath frame 12 are two lateral ground skid bars constructed of angle iron, indicated by numeral 18. The front ends of the ground skid bars 18 are angled upward to prevent apparatus from digging in, easing its progression. The rear ends of the ground skid bars 18 are angled outward to rake spoils away from banks. The vertical support braces in rear are of different design and purpose. On the left side, the vertical brace houses a mechanical drive to power the enclosed rotational excavation apparatus' axle, and is larger than that on the right. The right vertical brace, indicated by numeral 22, is made of channel iron for easy access to the axle attachment located on lower lateral perimeter. Thus, the rotational excavating apparatuses of varied shapes are easily interchangeable.

Connected to the upper front perimeter of frame 12 is a gear box, indicated by numeral 24, diverting rotational power from the tractor's power-take-off to axle's drive box 20 on the left. A drive shaft with a universal joint, indicated by numeral 26, links power from power-take-off to gear box 24. Gear box 24 also acts a structural support bracing upper front perimeter frames together. Supporting the gear box is a brace angled up to the top link 14 of the three-point-hitch. The axle drive box, indicated by numeral 20, reduces rotations-per-minute by a pre-determined ratio of approximately three-to-one.

Within the frame of the proposed implement is a rotational excavating apparatus for excavating foundation footings or trenches having a flat base and vertical sides, indicated by numeral 30. The rotational excavating apparatus 30 is made of three or more sections fastened together to form a cylindrical, drum-shaped apparatus, or may be constructed as one unit. If fastened together, the outside sections are easily removed for a narrower width of cut. Also, by removing outer sections, the center section is useful as a narrow trencher. The rotational excavating apparatus sections 30 are surfaced with claws, indicated by numeral 32. Claws 32 are fastened at angles to force soil toward banks of excavated linear depression, depositing soil forward and laterally on banks of linear depression. Direction of apparatus' rotation is indicated by numeral 34.

The front of the proposed implement 10 has a protective metal guard, indicated by numeral 36, protecting operator from flying debris. Protective metal guard 36 is welded to frame 12 and to upper hitch supports 14. An opening is cut into protective metal guard 36 for movement of driveshaft 26.

Mounted on the front lower perimeter of frame 12 is also a small guide disk, indicated by numeral 38. The guide disk 38 prevents lateral or weaving movements and helps direct apparatus. The operator can use center-line ground markings to help monitor the guide disk, maintaining it at the center of intended excavation.

Figure 3:
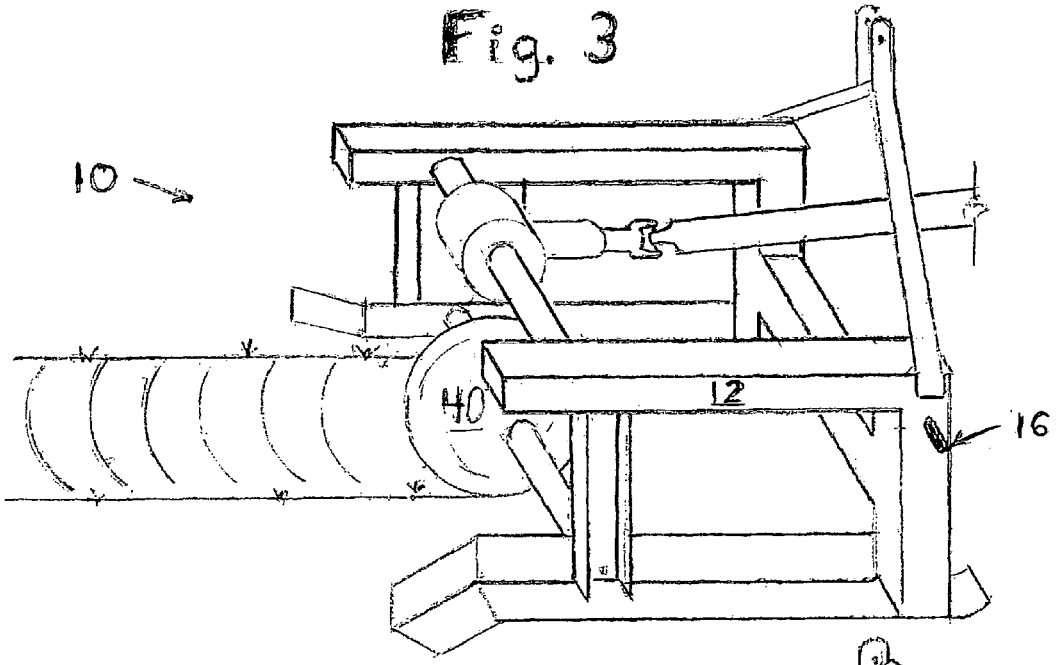
FIG. 3 shows a perspective view of the implement with a rotational excavating apparatus of spherical shape attached for forming circular or rounded-U-shaped ditches.

FIG. 3 shows the proposed implement 10 with a spherical rotational excavating apparatus. This spherical rotational excavating apparatus, indicated by numeral 40, is for excavating a small, circular or rounded-U-shaped ditch. The spherical rotational excavating apparatus 40 is surfaced with claws 32 fastened at angles. This apparatus has its own axle and is of smaller dimension; therefore lower hitch pins 16 are mounted to outside of frame 12. All other parts remain the same as in FIG. 2.

Figure 4:
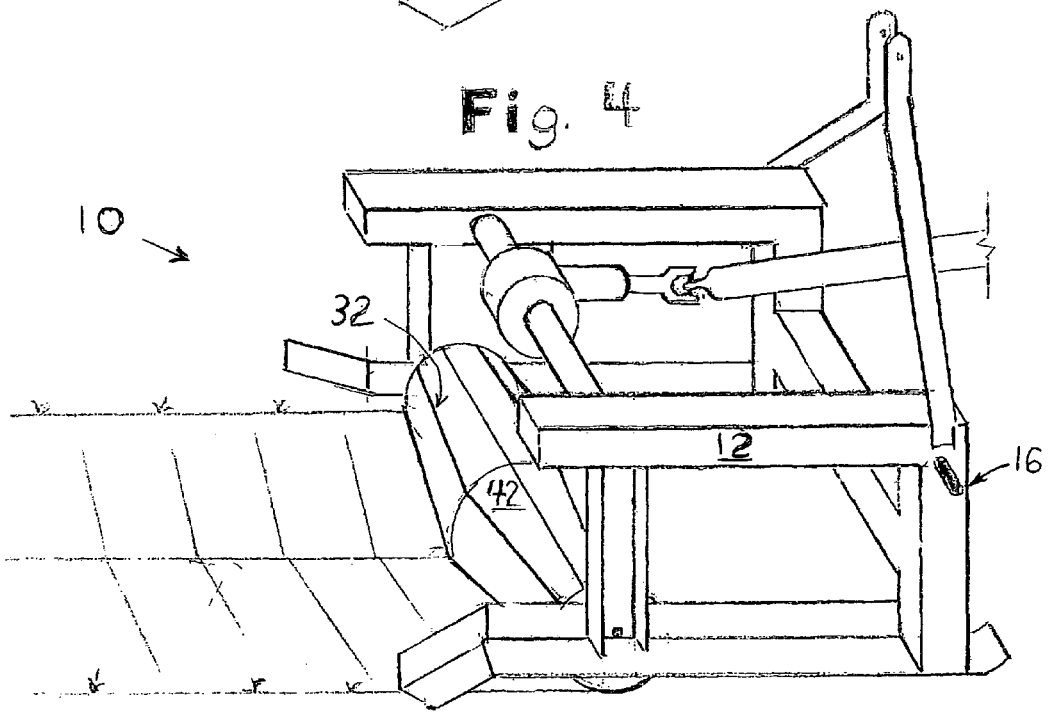
FIG. 4 shows a perspective view of the implement with a rotational excavating apparatus of prolate ellipsoidal shape attached for forming shallow or rounded-V-shaped ditches.

FIG. 4 shows the proposed implement 10 with a prolate ellipsoid rotational excavating apparatus for excavating a shallow, rounded-V-shaped, easily mowed ditch. This ellipsoidal rotational excavating apparatus, indicated by numeral 42, is surfaced with claws 32 fastened at angles. This apparatus, like the spherical one, has its own axle and is of smaller dimension; thus the lower hitch pins 16 are mounted to outside of frame 12. All other parts remain the same.

What is claimed is:

1. A tractor-mounted implement, mounted on a tractor having a three-point hitch, hydraulics, and a rotational power-take-off unit for the task-associated excavation of linear depressions, wherein excavation tasks include, but are not limited to, forming foundation footings, ditches, or trenches, and whereby excavated spoils are deposited on banks of a newly formed linear depression, and with the implement comprising:

a. a substantially rectangular box-shaped perimetrical frame structure, constructed from iron or other dense, heavy metal, assembled on lateral ground skid bars having a forward upward slant to ease advancement of said perimetrical frame when pulled along the ground, and b. a means of harvesting and directing soil from underneath to outside and away form said perimetrical frame, comprising:

i. a task-associated rotational excavating apparatus, of practical width and shape for a selected task, attached within a rear portion of said perimetrical frame structure, ii. a power diversion system relating the tractor's power-take-off unit to an axle of said rotational excavating apparatus, and iii. outwardly angled rear portions of said lateral ground skid bars.

2. The power diversion system as described in claim 1, wherein said power diversion system comprises a common transmission drive shaft attached to the tractor's power-take-off unit and a proximal gear box linked to a laterally distal axle drive box comprising a drive system of gears, belts and pulleys, or chain and sprockets, and whereby power from said tractor's power-take-off unit is ultimately related to said rotational excavating apparatus.

3. The substantially rectangular box-shaped perimetrical frame structure on lateral ground skid bars as defined in claim 1, wherein at least one guide disk is attached to a front lower perimeter of the perimetrical frame structure to guide linear advancement, and whereby an operator is able to maintain a center of the rotational excavating apparatus on ground-drawn lines for precise linear excavation without excessive weaving or deviation from said ground-drawn lines, such as is compulsory for foundation footings.

4. The substantially rectangular box-shaped perimetrical frame structure on lateral ground skid bars as defined in claim 1, wherein a metal guard is attached on a forward perimeter of said frame structure, and whereby an operator is protected from excavated debris.

5. The rotational excavating apparatus as defined in claim 1, wherein a depth of excavation is adjustable by moving the three-point-hitch using the hydraulics of the tractor.

6. The laterally distal axle drive box as defined in claim 2, constructed with at least one larger and one smaller pulley or sprocket of pre-determined sizes arranged to lower rotations-per-minute of said rotational excavating apparatus compared to tractor power-take-off-driven gears, at a predetermined ratio, whereby rotation of said rotational excavating apparatus is slowed for adequate time to harvest and direct soil.

7. The rotational excavating apparatus as defined in claim 1 wherein said rotational excavating apparatus comprises a solid base and a plurality of laterally angled, soil harvester claws attached to said solid base at pre-determined angles, and whereby soil is collected, guided forward up to a surface and outward toward lateral perimeters of said perimetrical frame structure.

8. The substantially rectangular box-shaped perimetrical frame structure on lateral ground skid bars with outwardly angled rear portions as defined in claim 1, whereby soil guided to said lateral skid bars by said rotational excavating apparatus is then raked out away from a body of said perimetrical frame structure onto outer banks of said linear depression.

9. The rotational excavating apparatus as defined in claim 1, wherein said rotational excavating apparatus further comprises interchangeable task-associated rotational excavating apparatuses in a plurality of shapes, and whereby differing linear depressions may be excavated, comprising:

a. a substantially cylindrical, drum-shaped apparatus, whereby a foundational footing or trench with substantially vertical sides and a substantially flat, horizontal base may be excavated, with said drum-shaped cylindrical apparatus comprising a plurality of interconnected sections wherein said sections in lateral positions can be removed for excavating narrower footings or trenches, and b. a substantially spherical apparatus, whereby a substantially circular or rounded-U-shaped ditch may be excavated, and c. a substantially prolate ellipsoidal apparatus, whereby a substantially shallow parabolic or rounded-V-shaped ditch bay be excavated.

* * * * *